US009316108B2

(12) United States Patent
Pegan, Jr. et al.

(10) Patent No.: US 9,316,108 B2
(45) Date of Patent: Apr. 19, 2016

(54) GAS TURBINE FRAME STIFFENING RAILS

(75) Inventors: Courtland Earl Pegan, Jr., Norwood, OH (US); Kurt Thomas Hildebrand, Cincinnati, OH (US); Scott Patrick Ryczek, Cincinnati, OH (US); Derek Thomas Dreischarf, Bellbrook, OH (US)

(73) Assignee: General Electric Company, Schenectady, NY (US)

( * ) Notice: Subject to any disclaimer, the term of this patent is extended or adjusted under 35 U.S.C. 154(b) by 1023 days.

(21) Appl. No.: 13/412,014

(22) Filed: Mar. 5, 2012

(65) Prior Publication Data

US 2013/0227930 A1 Sep. 5, 2013

(51) Int. Cl.
*F01D 9/06* (2006.01)
*F01D 25/16* (2006.01)

(52) U.S. Cl.
CPC ..... *F01D 9/065* (2013.01); *F01D 25/162* (2013.01)

(58) Field of Classification Search
CPC ..... F01D 9/065; F01D 25/162
USPC ..... 60/805; 415/142, 213.1, 209.4
See application file for complete search history.

(56) References Cited

U.S. PATENT DOCUMENTS 3,403,889 A 10/1968 Ciokajlo et al.
4,492,078 A * 1/1985 Williamson ..... 60/797
5,076,049 A 12/1991 Von Benken et al.
5,160,251 A * 11/1992 Ciokajlo ..... 415/209.2
5,259,183 A * 11/1993 Debeneix ..... 60/797
5,273,397 A 12/1993 Czachor et al.
5,483,792 A * 1/1996 Czachor et al. ..... 60/796
6,439,616 B1 * 8/2002 Karafillis et al. ..... 411/120
7,770,292 B2 8/2010 Stretton
7,797,922 B2 9/2010 Eleftheriou
2010/0132374 A1 * 6/2010 Manteiga et al. ..... 60/796
2013/0115057 A1 * 5/2013 Suciu et al. ..... 415/170.1

FOREIGN PATENT DOCUMENTS

CN 101105150 A 1/2008
EP 2589759 A2 5/2013

OTHER PUBLICATIONS

Search Report and Written Opinion from corresponding EP Application No. 13157894, dated May 31, 2013.
Unofficial English Translation of Chinese Office Action issued in connection with corresponding CN Application No. 201310069125.5 on Sep. 22, 2015.

* cited by examiner

*Primary Examiner* — Ted Kim
(74) *Attorney, Agent, or Firm* — General Electric Company; William Scott Andes

(57) ABSTRACT

Gas turbine engine frames are disclosed. An example gas turbine engine frame may include a generally annular outer casing disposed coaxially about a hub; a plurality of circumferentially spaced apart struts joined to the hub and the outer casing, individual struts extending radially outwardly from the hub to the outer casing; and a stiffening rail monolithically formed with the outer casing circumferentially between two of the struts. The stiffening rail may extend radially inward beyond the inner surface of the outer casing between the struts.

21 Claims, 11 Drawing Sheets

GAS TURBINE FRAME STIFFENING RAILS

BACKGROUND

The subject matter disclosed herein relates generally to gas turbine engine frames for supporting bearings and shafts, and, more specifically, to stiffening structures, such as rails, associated with gas turbine engine frame casings.

Gas turbine engines may include one or more rotor shafts supported by bearings which, in turn, may be supported by generally annular engine frames. An engine frame may include a generally annular casing spaced radially outwardly from an annular hub, with a plurality of circumferentially spaced apart struts extending therebetween. The struts may be integrally formed with the casing and hub in a common casting, for example, or may be suitably mechanically attached thereto. In either case, the engine frame may be configured to have suitable structural rigidity for supporting the rotor shaft and to minimize deflections of the rotor shaft during operation.

Engine frames may be configured to transmit loads from the internal rotor bearing support, through the hub, across the engine flowpath, such as by generally equally spaced struts, to flanges disposed on the case. Because the bearing load may be transferred into the case at local points, e.g., the strut ends, the design of the case may be important to the overall frame stiffness. Bending may occur in relatively thin annular case sections due to these point loads, which may introduce unwanted flexibility in the engine frame.

Thermal effects may play a role in the design of gas turbine engine frames, particularly to hot section applications. For example, a severe thermal gradient may develop between the hot casing, which may be at least partially exposed to engine core air on its inner surface, and relatively cool stiffener rings, which may be exposed to under-cowl air during engine operation. These gradients may cause thermal stresses that may lead to cracking and may sometimes require active heating of the reinforcing rings to avoid such distress.

The problem: For gas turbine engine frames having low numbers of struts, it may be difficult to provide a substantially direct load path on the casing between the struts while maintaining a substantially circular casing.

BRIEF DESCRIPTION

The solution for the above-mentioned problem is provided by the present disclosure to include example embodiments, provided for illustrative teaching and not meant to be limiting.

An example gas turbine engine frame according to at least some aspects of the present disclosure may include a generally annular outer casing disposed substantially coaxially about a centerline axis, the outer casing including an outer surface facing radially outward away from the centerline axis and an inner surface facing radially inward toward the centerline axis; a hub disposed within the outer casing and spaced radially inward from the inner surface of the outer casing, the hub being arranged substantially coaxially about the centerline axis; a plurality of circumferentially spaced apart struts fixedly joined to the hub and the outer casing, individual struts extending generally radially outwardly from the hub to the outer casing; and/or a stiffening rail monolithically formed with the outer casing circumferentially between two of the struts (e.g., a pair of adjacent struts), the stiffening rail having a height radially outward beyond the outer surface of the outer casing generally approximate a first one of the struts and generally approximate a second one of the struts, and a depth radially inward beyond the inner surface of the outer casing between the first strut and the second strut.

An example gas turbine engine frame according to at least some aspects of the present disclosure may include a generally annular outer casing disposed substantially coaxially about a centerline axis, the outer casing including an outer surface facing radially outward away from the centerline axis and an inner surface facing radially inward toward the centerline axis; a hub disposed within the outer casing and spaced radially inward from the inner surface of the outer casing, the hub being arranged substantially coaxially about the centerline axis; a plurality of circumferentially spaced apart struts fixedly joined to the hub and the outer casing, individual struts extending generally radially outwardly from the hub to the outer casing; and/or a first stiffening rail and a second stiffening rail monolithically formed with the outer casing circumferentially between two of the struts (e.g., a pair of adjacent struts), the first stiffening rail and the second stiffening rail arranged substantially in parallel in a generally circumferential direction, each of the first stiffening rail and the second stiffening rail having a height radially outward beyond the outer surface of the outer casing generally approximate a first one of the struts and generally approximate a second one of the struts, and a depth radially inward beyond the inner surface of the outer casing between the first strut and the second strut. The depth of the first stiffening rail and the depth of the second stiffening rail may increase from minimums approximate the first strut and the second strut to maximums substantially midway between the first strut and the second strut. The height of the first stiffening rail and the height of the second stiffening rail decrease from maximums approximate the first strut and the second strut to minimums substantially midway between the first strut and the second strut.

An example gas turbine engine according to at least some aspects of the present disclosure may include a low-pressure compressor; a high-pressure compressor; a combustor; a high-pressure turbine arranged to drive the high-pressure compressor via a first shaft; and/or a low-pressure turbine arranged to drive the low-pressure compressor via a second shaft. The first shaft and/or the second shaft may be at least partially supported by a hub of a turbine frame. The turbine frame may include a generally annular outer casing disposed substantially coaxially with the hub. The outer casing may include an outer surface facing radially outward away from the hub and an inner surface facing radially inward toward the hub, the inner surfacing being spaced radially outward from the hub. The turbine frame may include a plurality of circumferentially spaced apart struts fixedly joined to the hub and the outer casing, individual struts extending generally radially outwardly from the hub to the outer casing, and a stiffening rail monolithically formed with the outer casing circumferentially between two of the struts (e.g., a pair of adjacent struts), the stiffening rail having a depth radially inward beyond the inner surface of the outer casing between the first strut and the second strut.

BRIEF DESCRIPTION OF THE DRAWINGS

The subject matter for which patent claim coverage is sought is particularly pointed out and claimed herein. The subject matter and embodiments thereof, however, may be best understood by reference to the following description taken in conjunction with the accompanying drawing figures in which:

DETAILED DESCRIPTION

Figure 1:
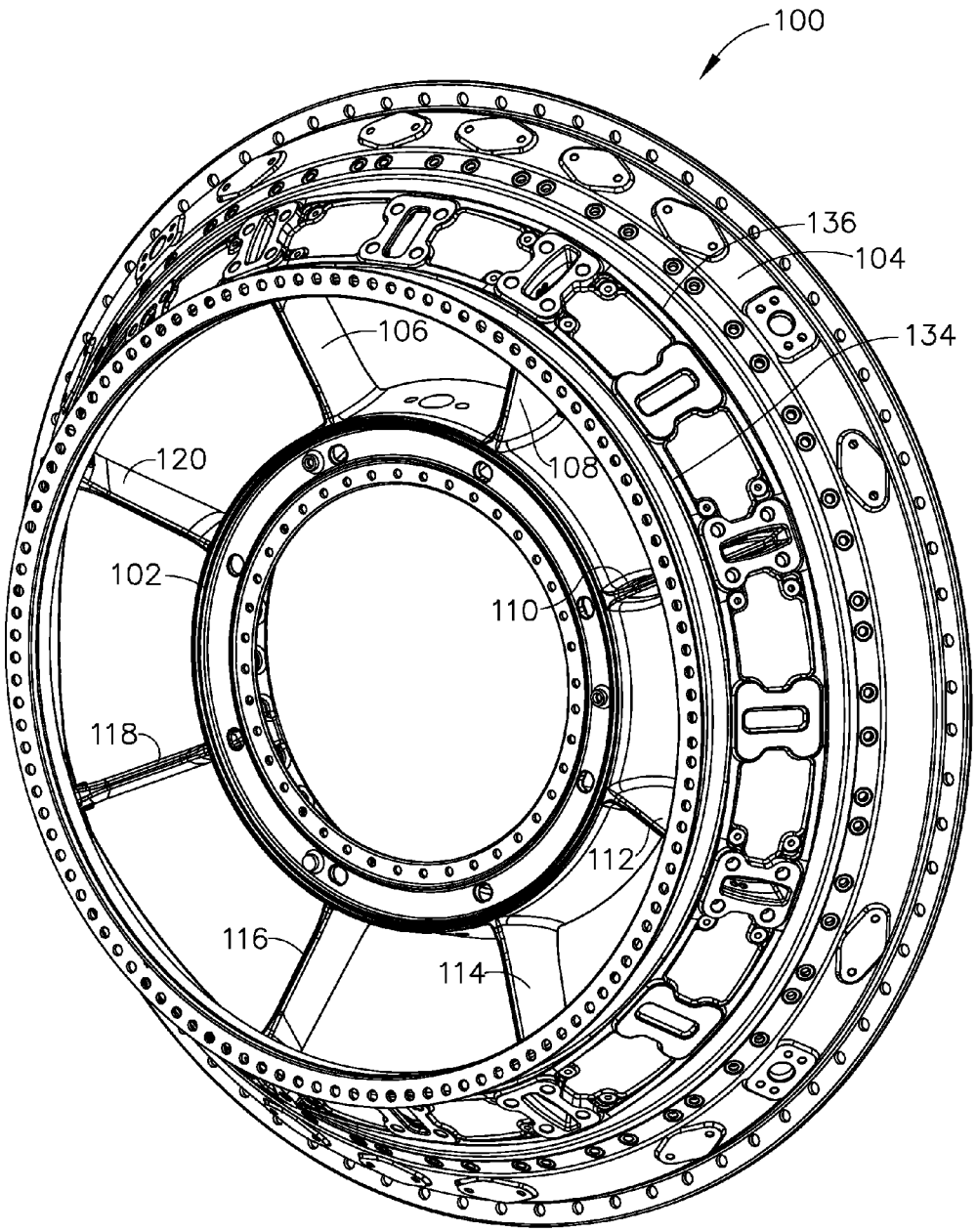
FIG. 1 is a perspective view of an example gas turbine engine frame.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

The present disclosure includes, inter alia, gas turbine engine frames for supporting bearings and shafts, and, more specifically, to stiffening structures, such as rails, associated with gas turbine engine frame casings.

The present disclosure contemplates that, in some circumstances, it may be advantageous to reduce the number of struts extending from a central hub to casing in a gas turbine engine frame. For example, reducing the number of struts from 12 to eight may reduce the weight of the engine frame. For low numbers of struts, however, it may be difficult to create a direct load path on the casing between struts while providing a substantially circular casing.

The present disclosure contemplates that stiffening structures, such as rails, disposed on the outside of a casing may be relatively easy to manufacture and may leave the interior of the casing uninterrupted. With the midpoint of a stiffening rail constrained to lie on the outside of a circular casing, however, the ends of the rail typically protrude above the casing. As the number of struts is reduced, arc length between the struts is increased, and the ends of the rails extend radially farther from the case. As the rails extend radially farther from the case, weight and thermal gradient concerns may arise.

Some example embodiments according to at least some aspects of the present disclosure may include gas turbine engine frames including generally thin annular casings stiffened by stiffening structures configured to carry predominantly tension stress and/or to experience low thermal stresses. Some example stiffening rails may protrude into the interior of the casing, which may bring the ends of the rails radially inward and closer to the struts. In addition, stiffening rails that protrude at least partially into the interior of the casing may develop smaller thermal gradients between the casing and the rail as compared to external stiffening rails, as more volume of the rails may be exposed to the core environment. This increased exposure may bring the rail temperatures closer to the temperature of the casing, which may reduce thermal stresses. In some example embodiments, stiffening rails may be passively exposed to temperatures within the casing. As described below, in some example embodiments, relatively warmer or cooler air may be actively directed onto at least some of the rails to reduce thermal stresses. Further still, stiffening rails that protrude at least partially into the interior of the casing may be able to maintain a substantially constant cross section as they traverse the case, which may allow more interior space for the placement of interfacing hardware on the casing between struts.

FIG. 1 is a perspective view of an example gas turbine engine frame 100, according to at least some aspects of the present disclosure. Engine frame 100 may include a central hub 102, a generally annular outer casing 104, and a plurality of circumferentially spaced apart struts 106, 108, 110, 112, 114, 116, 118, 120, which may extend generally radially outwardly from hub 102 to casing 104.

Figure 14:
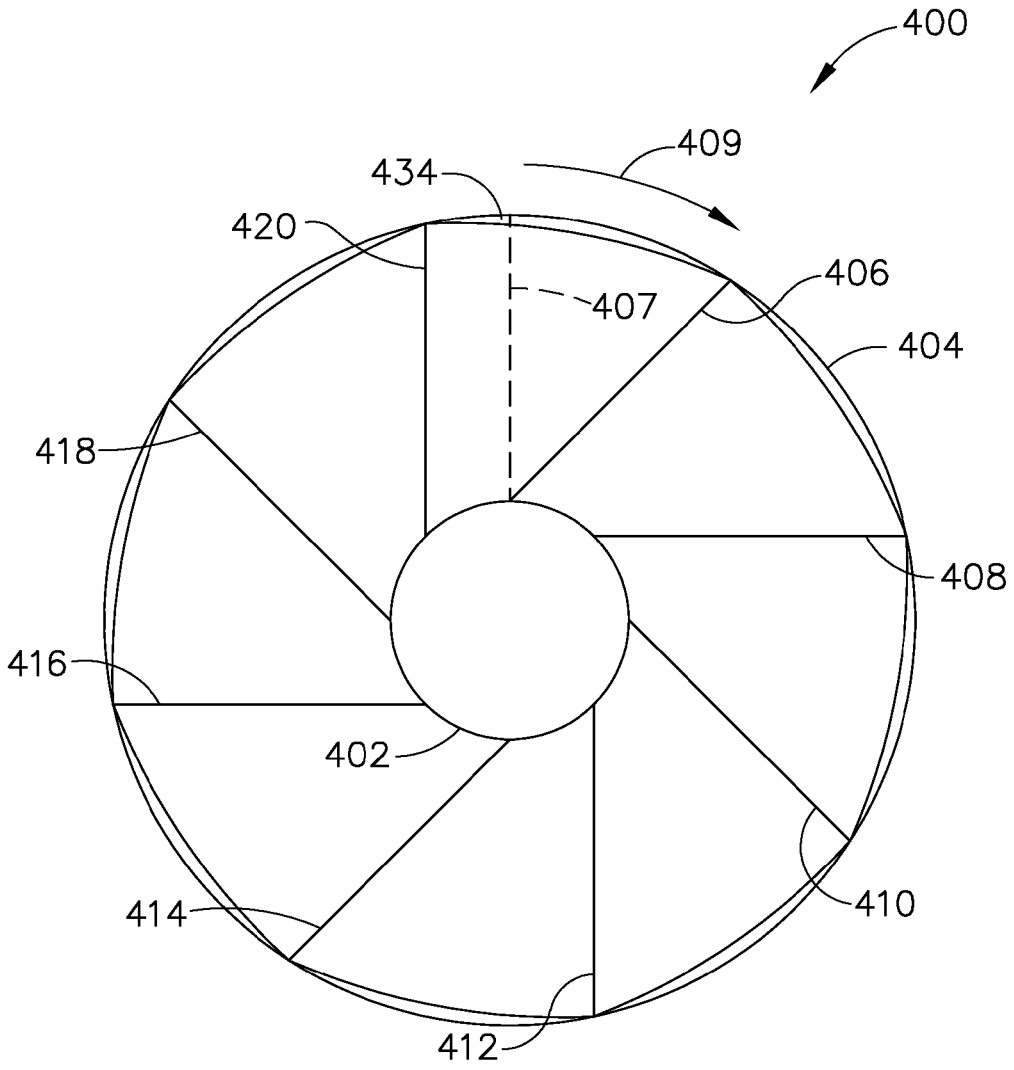
FIG. 14 is an axial view of an example turbine engine frame including tangentially leaned struts.

As described herein, struts extending generally radially outwardly from a hub may be substantially radially oriented (e.g., as shown in FIG. 1) and/or may be tangentially leaned. FIG. 14 is an axial view of an example turbine engine frame 400 including tangentially leaned struts 406, 408, 410, 412, 414, 416, 418, 420, according to at least some aspects of the present disclosure. Engine frame 400 may include a central hub 402, a generally annular outer casing 404, struts 406, 408, 410, 412, 414, 416, 418, 420 extending generally radially outwardly from hub 402 to casing 404, and/or one or more generally circumferential stiffening rails 434 disposed on casing 404. Struts 406, 408, 410, 412, 414, 416, 418, 420 may be tangentially leaned, such as in the direction of arrow 409, with respect to a radius 407.

Returning to FIG. 1, casing 104 may include a stiffening structure, such as a forward stiffening rail 134 and/or a rear stiffening rail 136, which may extend generally circumferentially between struts 106, 108, 110, 112, 114, 116, 118, 120. In some example embodiments, stiffening rail 134 and stiffening rail 136 may be arranged substantially in parallel in a generally circumferential direction and/or may be axially spaced apart. One or more turbine frames 100 may be used in a gas turbine engine, as illustrated in FIG. 13.

Figure 13:
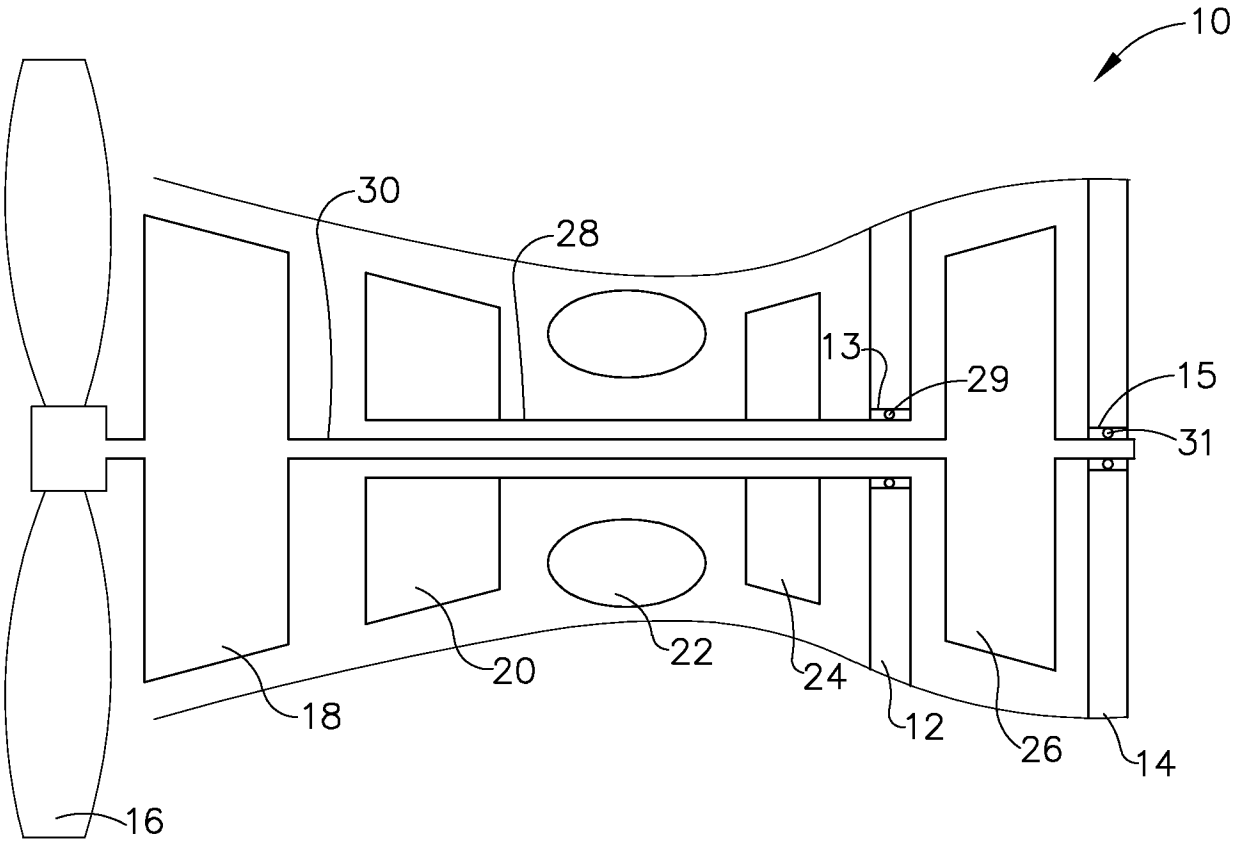
FIG. 13 is a block diagram of an example gas turbine engine.

FIG. 13 is a block diagram of an example gas turbine engine (GTE) 10 including a turbine center frame 12 and a turbine rear frame 14, according to at least some aspects of the present disclosure. GTE 10 may be configured to flow air through a fan 16, a low-pressure compressor 18, a high-pressure compressor 20, a combustor 22, a high-pressure turbine 24, and/or a low-pressure turbine 26. High-pressure turbine 24 may drive high-pressure compressor 20 via a shaft 28. Low-pressure turbine 26 may drive low-pressure turbine 18 and/or fan 16 via a shaft 30. Shaft 30 may be at least partially supported by a bearing 29 disposed in hub 13 of turbine center frame 12 and/or bearing 31 disposed in hub 15 of turbine rear frame 14. Turbine center frame 12 and/or turbine rear frame 14 may be generally similar to turbine frame 100, and hub 13 and/or hub 15 may generally correspond to hub 102.

Figure 2:
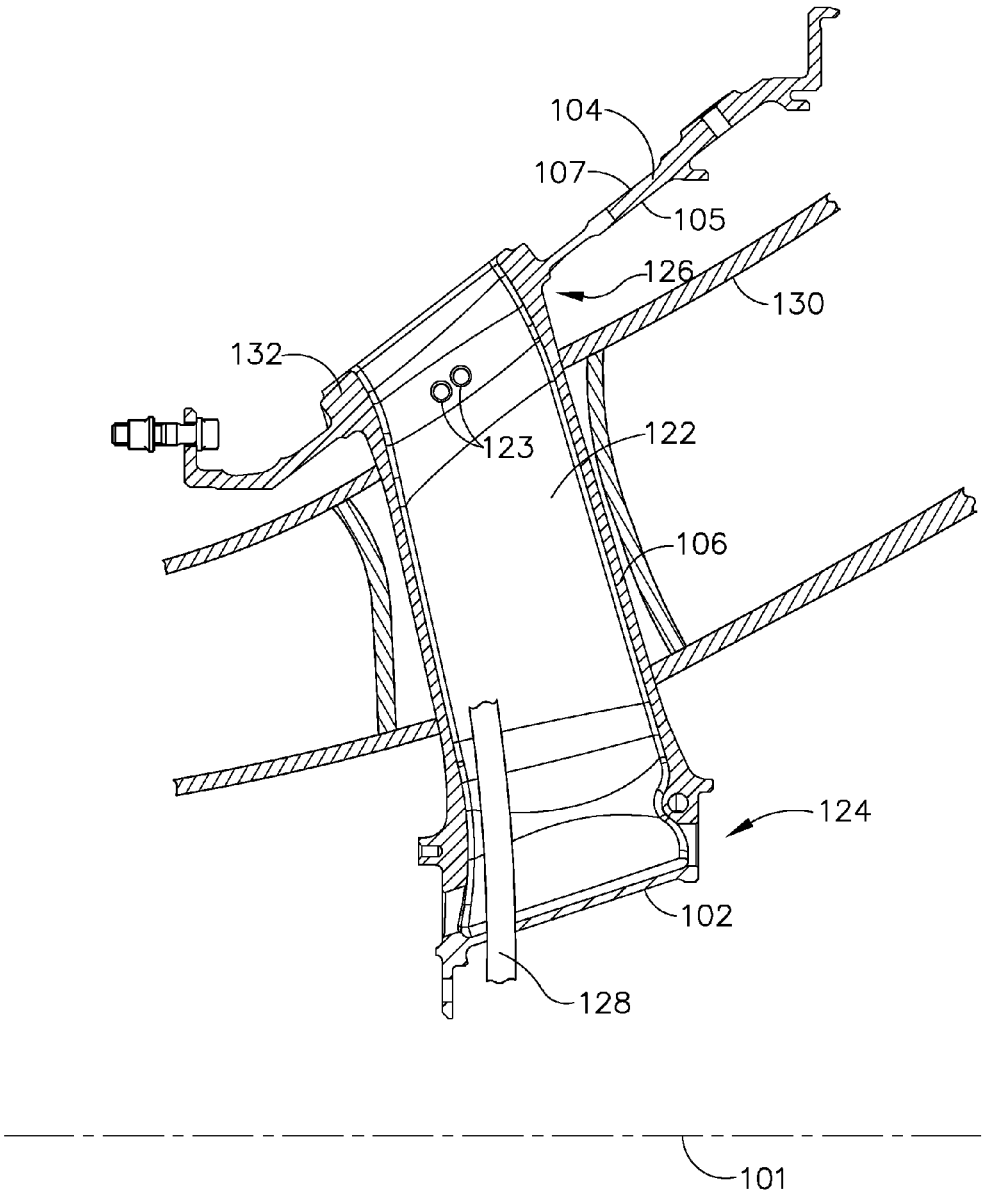
FIG. 2 is a sectional view of an example gas turbine engine frame at a strut.

FIG. 2 is a sectional view of an example gas turbine engine frame 100 at strut 106, according to at least some aspects of the present disclosure. Hub 102 and casing 104 may be arranged substantially coaxially about a centerline axis 101. Strut 106 may extend generally radially from hub 102 to outer casing 104. Outer casing 104 may include an outer surface 107 facing radially outward away from centerline axis 101. Outer casing may include an inner surface 105 facing radially inward toward centerline axis 101.

Strut 106 may be substantially hollow and/or may include a through channel 122 extending generally from a radially inner end 124 (which may be fixedly joined to hub 102) to a radially outer end 126 (which may be fixedly joined to casing 104). Through channel 122 may be configured to flow cooling airflow through strut 106 and/or to house one or more service lines 128 (e.g., oil lines, instrumentation lines, etc.). Strut 106 may receive one or more fairings 130 thereabout. Fairing 130 may be arranged to direct core flowpath gasses around strut 106. A boss 132 may be disposed approximate the intersection of radially outer end 126 of strut 106 and casing 104. Boss 132 may reduce localized stresses around strut 106 and/or may interface with stiffening rail 134 and/or stiffening rail 136 as described below.

In some example embodiments according to at least some aspects of the present disclosure, relatively warmer or cooler air may be actively directed onto stiffening rail 134 and/or stiffening rail 136. For example, relatively hot compressor bleed air drawn from low-pressure compressor 18 and/or high-pressure compressor 20 may be directed onto stiffening rail 134 and/or stiffening rail 136. In some example embodiments, compressor bleed air may be supplied to strut 106, and one or more openings 123 through strut 106 may direct the bleed air onto stiffening rail 134 and/or stiffening rail 136. Actively directing relatively warmer air (e.g., compressor bleed air) onto stiffening rail 134 and/or stiffening rail 136 may increase the temperature of stiffening rail 134 and/or stiffening rail 136, which may reduce thermal stresses.

In some example embodiments, struts 106, 108, 110, 112, 114, 116, 118, 120 may be substantially similar. Accordingly, the present disclosure describes the struts with reference to strut 106 and, unless otherwise indicated, struts 108, 110, 112, 114, 116, 118, 120 should be assumed to be substantially similar.

Figure 3:
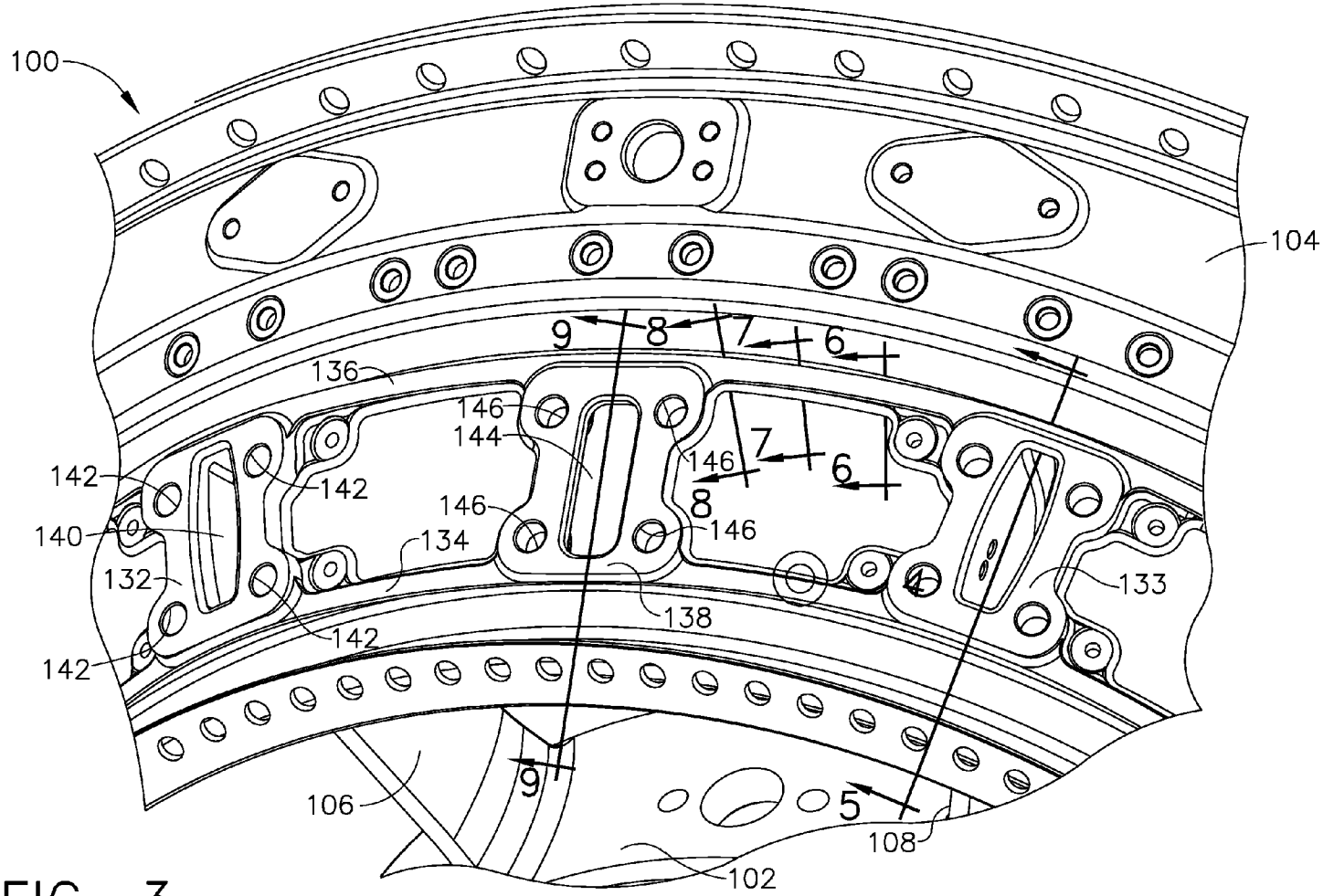
FIG. 3 is detailed exterior perspective view of an example casing of a gas turbine engine frame.
Figure 4:
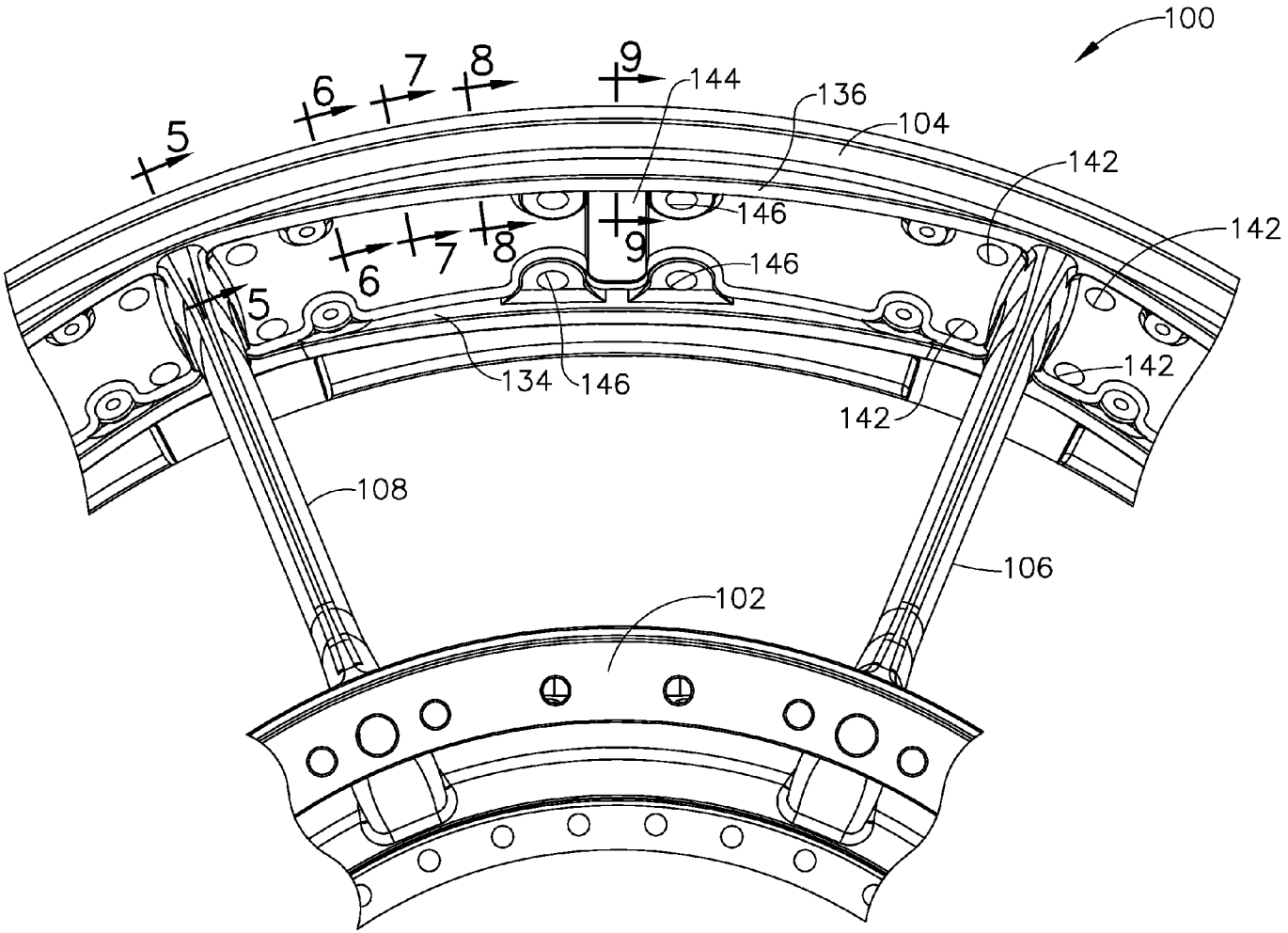
FIG. 4 is a detailed interior perspective view of an example casing of a gas turbine engine frame.

FIG. 3 is detailed exterior perspective view of an example outer casing 104 of gas turbine engine frame 100, according to at least some aspects of the present disclosure. FIG. 4 is a detailed interior perspective view of an example outer casing 104 of gas turbine engine frame 100, according to at least some aspects of the present disclosure. Outer casing 104 may include one or more stiffening structures disposed between respective bosses associated with struts 106, 108, 110, 112, 114, 116, 118, 120. As illustrated in FIGS. 3 and 4, outer casing 104 may include a forward stiffening rail 134 and/or a rear stiffening rail 136 extending generally circumferentially between boss 132 associated with strut 106 and boss 133 associated with strut 108. Stiffening rail 134 and/or stiffening rail 136 may intersect boss 132 and/or boss 133. One or more pads 138 may be disposed on outer casing 104 between two adjacent bosses 132. For example, pad 138 may be disposed on casing 104 between boss 132 associated with strut 106 and boss 133 associated with strut 108. Stiffening rail 134 and/or stiffening rail 136 may intersect pad 138.

In some example embodiments according to at least some aspects of the present disclosure, boss 132 (and other similar bosses) may comprise a thickened portion of outer casing 104 and/or may include a central opening 140 and/or one or more mounting holes 142 arranged around central opening 140. In some example embodiments according to at least some aspects of the present disclosure, pad 138 (and other similar pads) may comprise a thickened portion of casing 104 and/or may include a central opening 144 and/or one or more mounting holes 146. Central opening 140 and/or central opening 144 may allow one or more service lines (e.g., oil lines, instrumentation lines, etc.) to extend through casing 104. Mounting holes 142 and/or mounting holes 146 may be used to mount, for example, flanges associated with service lines. Some example embodiments may use opening 140 and/or opening 144 to deliver cooling air or purge air to various engine components.

FIGS. 5-9 are sectional views of an example casing 104 illustrating example stiffening rail 136, according to at least some aspects of the present disclosure. In some example embodiments, stiffening rail 134 may be configured substantially similar to stiffening rail 136; however, in other embodiments, stiffening rail 134 may be formed with a different size and/or shape than stiffening rail 136.

Figure 5:
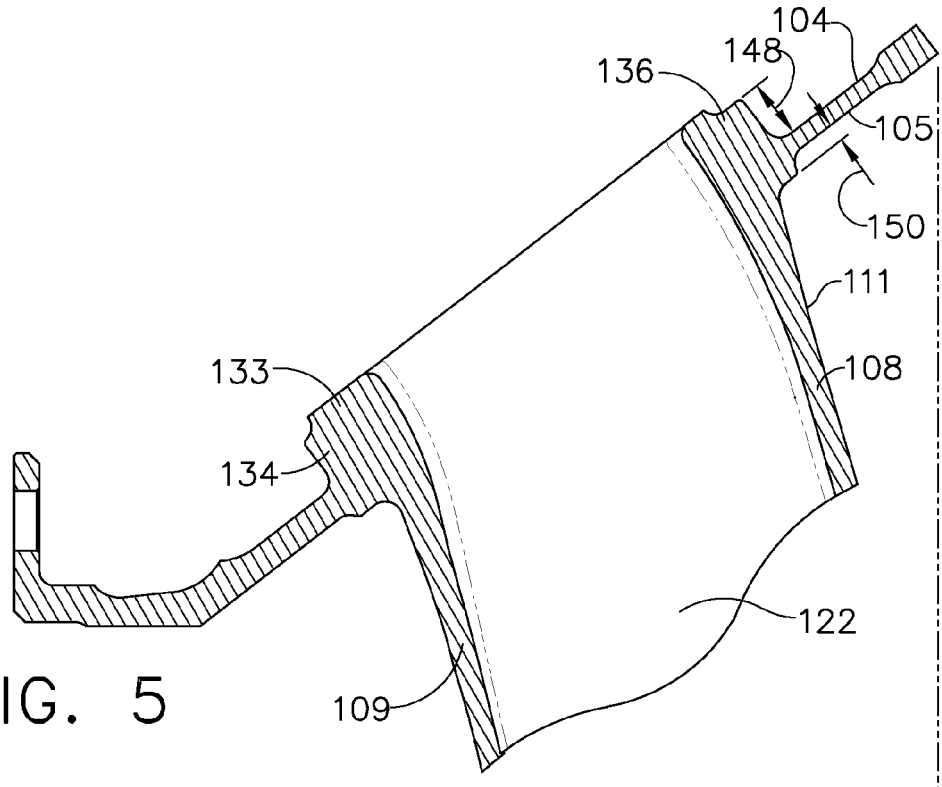
FIG. 5 is a sectional view of an example casing illustrating an example stiffening rail.

Referring to FIG. 5, at strut 108, stiffening rail 136 may be substantially contiguous with boss 133. Stiffening rail 136 may extend radially outward from outer casing 104 a substantially greater height 148 than a depth 150 that it extends radially inward from outer casing 104. In some example embodiments, stiffening rail 136 may be substantially flush with inner surface 105 of casing 104. In some example embodiments, stiffening rail 134 may be disposed generally approximate a leading edge 109 of strut 108 and/or stiffening rail 136 may be disposed generally approximate a trailing edge 111 of strut 108.

Figure 6:
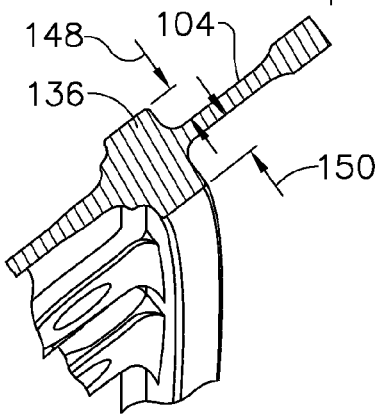
FIG. 6 is a sectional view of an example casing illustrating an example stiffening rail.

Referring to FIG. 6, between strut 108 and pad 138 near strut 108, stiffening rail 136 may radially outward from casing 104 by height 148 that is approximately the same as depth 150 that stiffening rail 136 extends radially inward from casing 104.

Figure 7:
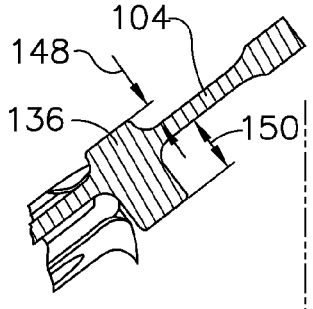
FIG. 7 is a sectional view of an example casing illustrating an example stiffening rail.

Referring to FIG. 7, also between strut 108 and pad 138, stiffening rail 136 may extend radially outward from casing 104 by height 148 that is substantially less than depth 150 that stiffening rail 136 extends radially inward from casing 104.

Figure 8:
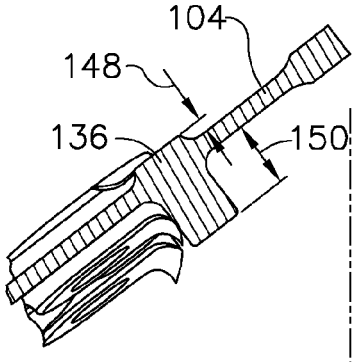
FIG. 8 is a sectional view of an example casing illustrating an example stiffening rail.

Referring to FIG. 8, between strut 108 and pad 138 near pad 138, stiffening rail 136 may extend radially outward from casing by height 18 that is substantially less than depth 150 that stiffening rail 136 extends radially inward from casing 104.

Figure 9:
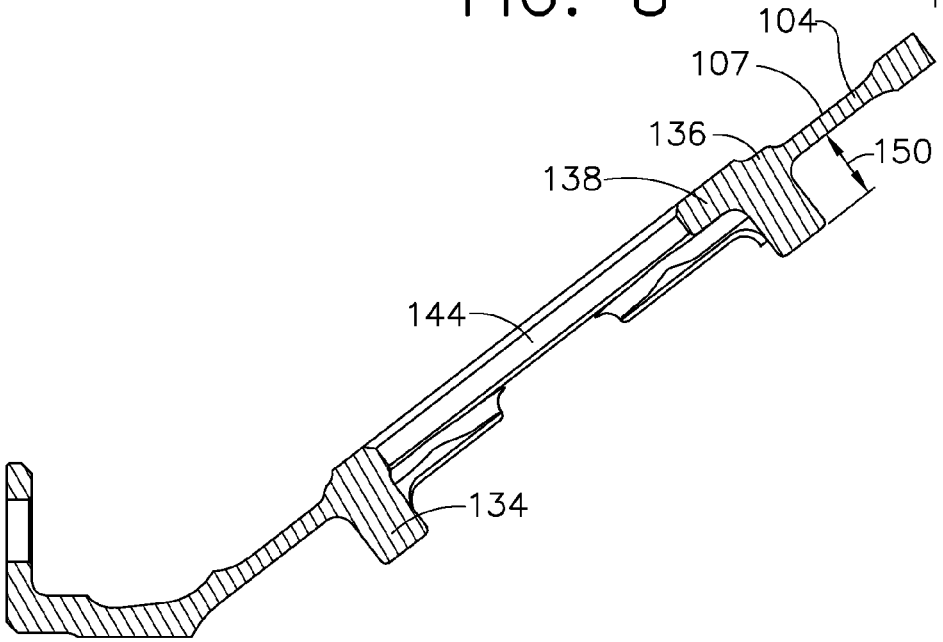
FIG. 9 is a sectional view of an example casing illustrating an example stiffening rail.

Referring to FIG. 9, stiffening rail 134 and/or stiffening rail 136 may be substantially contiguous with pad 138. Stiffening rail 136 may extend radially inward from casing 104 a depth 150. In some example embodiments, stiffening rail 136 may be substantially flush with outer surface 107 of casing 104.

In some example embodiments, depth 150 of stiffening rail 136 may increase from a minimum approximate strut 108 to a maximum approximate pad 138, which may be substantially midway between strut 106 and strut 108. In some example embodiments, height 148 of stiffening rail 136 may decrease from a maximum approximate strut 108 to a minimum approximate pad 138, which may be substantially midway between strut 106 and strut 108.

In some example embodiments according to at least some aspects of the present disclosure, cross-sectional areas and/or centroid distributions of stiffening rails may arranged to provide desired mean load lines in the stiffening rails. For example, depths and/or heights of one or more stiffening rails relative to the casing may be configured such that centroids of cross sections of the stiffening rails (e.g., tangential to the casing) are substantially linearly arranged. Such an arrangement may provide a substantially straight mean load line. In some example embodiments, one or more stiffening rails may be configured to have substantially constant cross sectional area circumferentially between a pair of adjacent struts.

Figure 10:
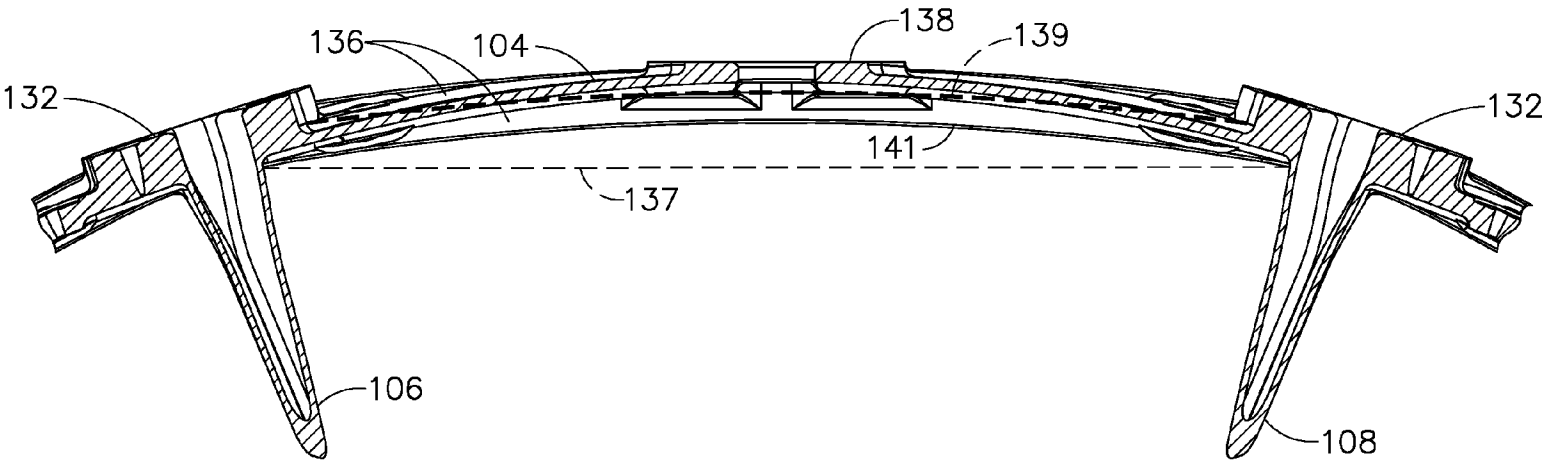
FIG. 10 is a sectional view of a casing illustrating an example stiffening rail.

FIG. 10 is a sectional view of casing 104 illustrating an example rear stiffening rail 136 extending from strut 106 to strut 108. In some example embodiments, stiffening rail 136 may be at least slightly curved with respect to a straight line 137 extending between strut 106 and strut 108. For example, radially inwardly facing surface 141 of stiffening rail 136 may be concavely curved. Stiffening rail 136 may provide a substantially straight mean load line 139 between outer casing 104 at strut 106 and outer casing 104 at strut 108.

Figure 11:
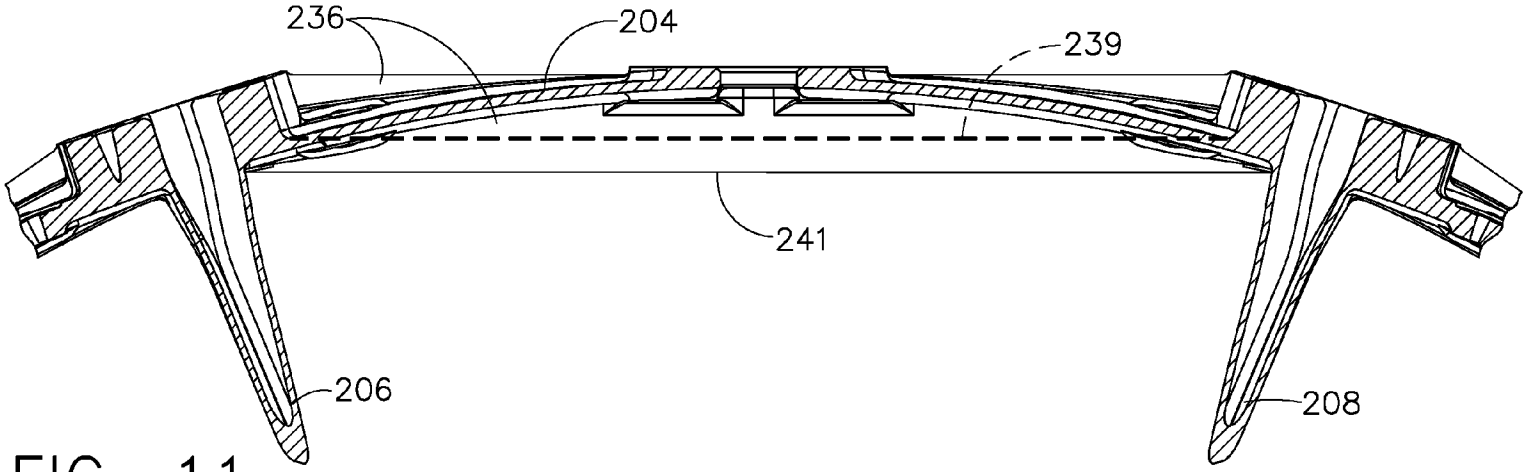
FIG. 11 is a sectional view of an example casing including an alternative example stiffening rail.

FIG. 11 is a sectional view of an example casing 204 including an alternative example stiffening rail 236. Stiffening rail 236 may be substantially similar to stiffening rail 136, except that stiffening rail 236 may be substantially straight between strut 106 and strut 108. For example, radially inwardly facing surface 241 of stiffening rail 236 may be substantially straight. Stiffening rail 136 may provide a substantially straight mean load line 239 between outer casing 204 at strut 206 and outer casing 204 at strut 208.

Figure 12:
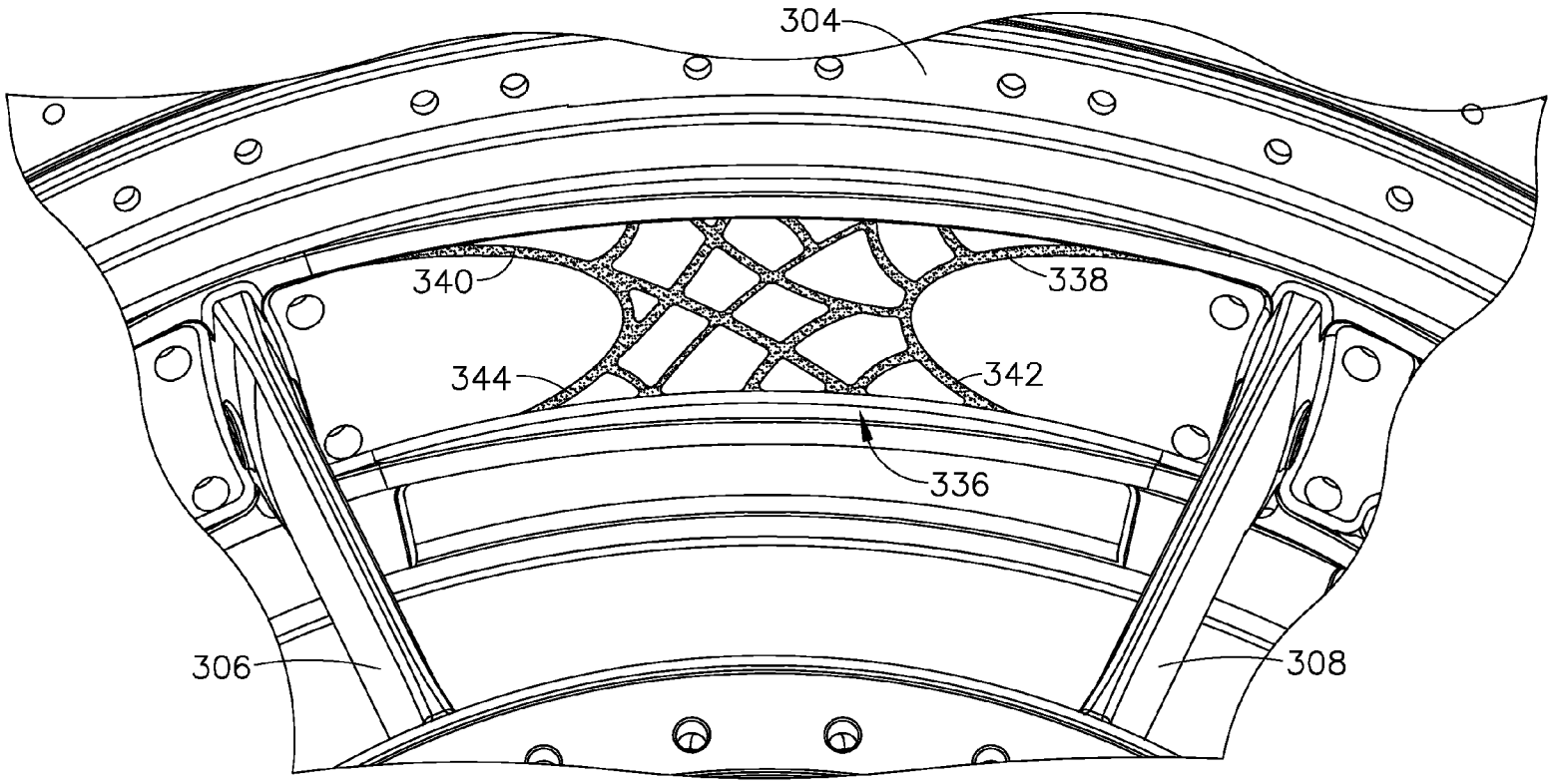
FIG. 12 is a detailed perspective view of a casing including an alternative example stiffening rail.

FIG. 12 is a detailed perspective view of an outer casing 304 including an alternative example stiffening rail 336, according to at least some aspects of the present disclosure. Stiffening rail 336 may include one or more reinforcing ligaments 338, 340, 342, 344 formed on outer casing 304. Ligaments 338, 340, 342, 344 may be arranged generally in the form of a web extending generally between a strut 306 and a strut 308. Some or all ligaments 338, 340, 342, 344 may be curved or straight. Some ligaments 338, 340, 342, 344 may be arranged to intersect other ligaments 338, 340, 342, 344 at an angle. In some example embodiments, stiffening rail 336 may extend radially inward and/or outward from outer casing 304 in a generally similar manner to stiffening rail 136 illustrated in FIG. 10. For example, stiffening rail 336 may be at least slightly curved with respect to a straight line extending between strut 306 and strut 308. In some example embodiments, stiffening rail 336 may extend radially inward and/or outward from outer casing 304 in a generally similar manner to stiffening rail 236 illustrated in FIG. 11. For example, stiffening rail 336 may be substantially straight between strut 306 and strut 308. In some example embodiments, stiffening rail 336, including ligaments 338, 340, 342, 344, may provide a mean load line that is radially inward compared to a casing without a stiffening rail. In some example embodiments, stiffening rail 336, including ligaments 338, 340, 342, 344, may provide a mean load line that is substantially straight between strut 306 and strut 308.

Figure 15:
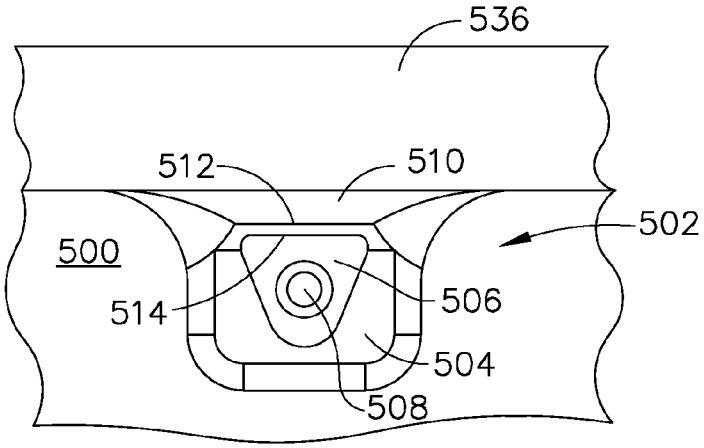
FIG. 15 is a detailed plan view of an example rail including a fastener interface.

Some example embodiments may include stiffening rails configured to operatively engage fasteners. FIG. 15 is a detailed plan view of an example rail 536 including a fastener interface 502, according to at least some aspects of the present disclosure. Rail 536 may extend from an inner surface 500 of a gas turbine engine frame. Fastener interface 502, which may be integrally formed with rail 536 and/or inner surface 500, may include a surface 504 arranged to receive a nut 506, which may be threadedly engaged with a bolt 508 extending through surface 504. Fastener interface 502 may include a lateral face 512, such as on a projection 510. Nut 506, which may comprise a shank nut, may include a lateral face 514 arranged to operatively engage face 512 of fastener interface 502. In some example embodiments, the engagement of face 514 of nut 506 with face 512 of projection 510 may prevent substantial rotation of nut 506. In some example embodiments, similar fastener interface features may be used in connection with D-head bolts and/or other fasteners providing anti-rotation features.

Figure 16:
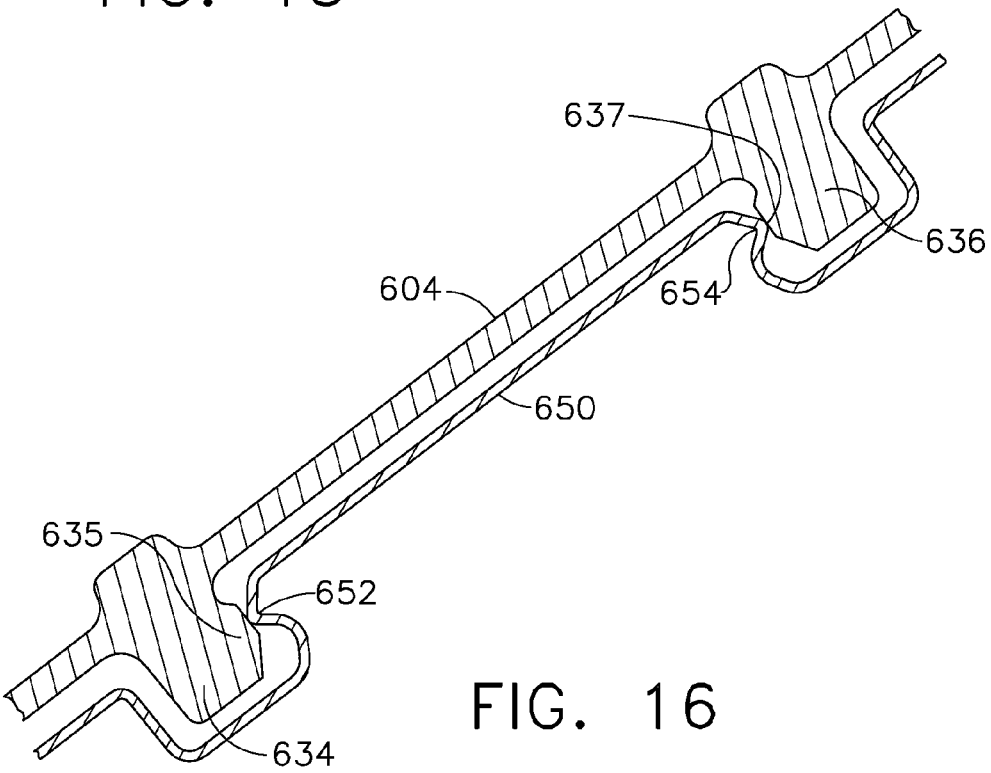
FIG. 16 is a [insert] of an example turbine engine frame including stiffening rails supporting a heat shield, all in accordance with at least some aspects of the present disclosure.

Some example embodiments may include stiffening rails configured to support other components. FIG. 16 is a cross sectional view of an example turbine engine frame including a stiffening rail 634 and/or a stiffening rail 636 supporting a heat shield 650, according to at least some aspects of the present disclosure. Stiffening rail 634 and/or stiffening rail 636 may be disposed on an inner surface 605 of an outer casing 604 of a gas turbine engine frame, as described elsewhere herein. Heat shield 650, which may be at least partially spaced apart from inner surface 605 of casing 604, may include a projection 652 and/or a projection 654, which may be arranged to operatively engage projection 635 and/or projection 637 on stiffening rail 634 and/or stiffening rail 636, respectively. In some example embodiments, heat shield 650 may be constructed from sheet metal. In some example embodiments, the engagement of heat shield with stiffening rail 634 and/or stiffening rail 636 may provide a damping effect, which may reduce high-cycle fatigue.

Some example embodiments according to at least some aspects of the present disclosure may be constructed using a casting process. For example, casing 104, struts 106, 108, 110, 112, 114, 116, 118, 120, and/or hub 102 may be cast monolithically. Some example embodiments according to at least some aspects of the present disclosure may be constructed using a machining process. For example, at least some features of casing 104, struts 106, 108, 110, 112, 114, 116, 118, 120, and/or hub 102 may be formed by machining. Some example embodiments according to at least some aspects of the present disclosure may include one or more components (e.g., casing 104, struts 106, 108, 110, 112, 114, 116, 118, 120, and/or hub 102) that is mechanically attached or joined to another component, such as using one or more fasteners (e.g., bolts). Generally, components that are formed together (e.g., monolithically cast, machined from a common blank, etc.) and/or substantially rigidly coupled together (e.g., by mechanical attachment, welding, etc.) may be referred to as fixedly joined.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A gas turbine engine frame, comprising:

a generally annular outer casing disposed substantially coaxially about a centerline axis, the outer casing comprising an outer surface facing radially outward away from the centerline axis and an inner surface facing radially inward toward the centerline axis;

a hub disposed within the outer casing and spaced radially inward from the inner surface of the outer casing, the hub being arranged substantially coaxially about the centerline axis;

a plurality of circumferentially spaced apart struts fixedly joined to the hub and the outer casing, individual struts extending generally radially outwardly from the hub to the outer casing; and a stiffening rail monolithically formed with the outer casing circumferentially between two of the struts, the stiffening rail having a height radially outward beyond the outer surface of the outer casing generally approximate a first one of the struts and generally approximate a second one of the struts, and a depth radially inward beyond the inner surface of the outer casing between the first strut and the second strut;

wherein the depth of the stiffening rail increases from a minimum approximate the first strut to a maximum substantially midway between the first strut and the second strut, and wherein the height of the stiffening rail decreases from a maximum approximate the first strut to a minimum substantially midway between the first strut and the second strut.

2. The gas turbine engine frame of claim 1, wherein the stiffening rail provides a load path between the outer casing at the first strut and the outer casing at the second strut.

3. The gas turbine engine frame of claim 1, wherein the stiffening rail comprises a first stiffening rail and a second stiffening rail, and wherein the first stiffening rail and the second stiffening rail are arranged substantially in parallel in a generally circumferential direction.

4. The gas turbine engine frame of claim 1, wherein the stiffening rail has a mean load line.

5. The gas turbine engine frame of claim 1, wherein the stiffening rail comprises a radially inwardly facing surface, and wherein the radially inwardly facing surface of the stiffening rail is concavely curved.

6. The gas turbine engine frame of claim 1, further comprising a pad formed in the outer casing generally midway circumferentially between the first strut and the second strut, the pad comprising a central opening extending radially through the outer casing.

7. The gas turbine engine frame of claim 6, wherein the stiffening rail intersects the pad.

8. The gas turbine engine frame of claim 1, further comprising a first boss formed on the outer casing approximate the first strut and a second boss formed on the outer casing approximate the second strut;

wherein the stiffening rail intersects the first boss and the second boss.

9. The gas turbine engine frame of claim 1, wherein the stiffening rail comprises a plurality of intersecting ligaments arranged in a web and extending radially inward beyond the inner surface of the outer casing.

10. The gas turbine engine frame of claim 1, wherein the stiffening rail comprises a fastener interface configured to prevent substantial rotation of a fastener engaged therewith.

11. A gas turbine engine frame, comprising:

a generally annular outer casing disposed substantially coaxially about a centerline axis, the outer casing comprising an outer surface facing radially outward away from the centerline axis and an inner surface facing radially inward toward the centerline axis;

a hub disposed within the outer casing and spaced radially inward from the inner surface of the outer casing, the hub being arranged substantially coaxially about the centerline axis;

a plurality of circumferentially spaced apart struts fixedly joined to the hub and the outer casing, individual struts extending generally radially outwardly from the hub to the outer casing; and a first stiffening rail and a second stiffening rail monolithically formed with the outer casing circumferentially between two of the struts, the first stiffening rail and the second stiffening rail arranged substantially in parallel in a generally circumferential direction, each of the first stiffening rail and the second stiffening rail having a height radially outward beyond the outer surface of the outer casing generally approximate a first one of the struts and generally approximate a second one of the struts, and a depth radially inward beyond the inner surface of the outer casing between the first strut and the second strut;

wherein the depth of the first stiffening rail and the depth of the second stiffening rail increase from minimums approximate the first strut and the second strut to maximums substantially midway between the first strut and the second strut, and wherein the height of the first stiffening rail and the height of the second stiffening rail decrease from maximums approximate the first strut and the second strut to minimums substantially midway between the first strut and the second strut.

12. The gas turbine engine frame of claim 11, further comprising a pad formed in the outer casing generally midway circumferentially between the first strut and the second strut, the pad comprising a central opening extending radially through the outer casing.

13. The gas turbine engine frame of claim 12, wherein the pad extends axially from the first stiffening rail to the second stiffening rail.

14. The gas turbine engine frame of claim 12, wherein the pad comprises at least one mounting hole.

15. The gas turbine engine frame of claim 11, wherein a mean load line of the first stiffening rail and a mean load line of the second stiffening rail are between the first strut and the second strut.

16. The gas turbine engine frame of claim 11, wherein each of the first stiffening rail and the second stiffening rail comprises a radially inwardly facing surface, and wherein the radially inwardly facing surface of the first stiffening rail and the radially inwardly facing surface of the second stiffening rail are concavely curved.

17. A gas turbine engine comprising:

a low-pressure compressor;

a high-pressure compressor;

a combustor;

a high-pressure turbine arranged to drive the high-pressure compressor via a first shaft; and a low-pressure turbine arranged to drive the low-pressure compressor via a second shaft;

wherein at least one of the first shaft and the second shaft is at least partially supported by a hub of a turbine frame;

wherein the turbine frame comprises a generally annular outer casing disposed substantially coaxially with the hub, the outer casing comprising an outer surface facing radially outward away from the hub and an inner surface facing radially inward toward the hub, the inner surfacing being spaced radially outward from the hub, a plurality of circumferentially spaced apart struts fixedly joined to the hub and the outer casing, individual struts extending generally radially outwardly from the hub to the outer casing, and a stiffening rail monolithically formed with the outer casing circumferentially between two of the struts, the stiffening rail having a depth radially inward beyond the inner surface of the outer casing between the first strut and the second strut wherein the depth of the stiffening rail increases from a minimum approximate the first strut to a maximum substantially midway between the first strut and the second strut, and wherein the height of the stiffening rail decreases from a maximum approximate the first strut to a minimum substantially midway between the first strut and the second strut.

18. The gas turbine engine of claim 17, wherein the stiffening rail has a height radially outward beyond the outer surface of the outer casing generally approximate a first one of the struts and generally approximate a second one of the struts.

19. The gas turbine engine of claim 17, wherein the stiffening rail provides a load path between the outer casing at the first strut and the outer casing at the second strut.

20. The gas turbine engine of claim 17, wherein compressor bleed air is directed onto the stiffening rail.

21. The gas turbine engine of claim 17, further comprising a heat shield operatively engaged with the stiffening rail, the heat shield being at least partially spaced apart from the inner surface of the outer casing.

* * * * *